US008708310B2

(12) United States Patent
Edgerly

(10) Patent No.: US 8,708,310 B2
(45) Date of Patent: Apr. 29, 2014

(54) FLOORING INSTALLATION TOOL WITH ADJUSTABLE SHOE

(75) Inventor: Jeffrey Edgerly, Bristol, CT (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 1128 days.

(21) Appl. No.: 12/636,438

(22) Filed: Dec. 11, 2009

(65) Prior Publication Data

US 2011/0138737 A1 Jun. 16, 2011

(51) Int. Cl.

| | |
|---|---|
| ***B66F 3/00*** | (2006.01) |
| ***B66F 3/02*** | (2006.01) |
| ***E04G 21/00*** | (2006.01) |
| ***E04F 15/00*** | (2006.01) |

(52) U.S. Cl.
USPC ..... 254/11; 254/12; 52/749.11; 81/46

(58) Field of Classification Search
USPC ..... 254/11, 12, 100, 103, 98, 134; 52/749.1; 81/46
See application file for complete search history.

(56) References Cited

U.S. PATENT DOCUMENTS

| | | | | |
|---|---|---|---|---|
| 1,447,720 | A * | 3/1923 | Hall | 254/12 |
| 2,708,097 | A | 5/1955 | Hinger | 254/12 |
| 2,933,288 | A | 4/1960 | Sholick | 254/12 |
| 7,121,528 | B2 | 10/2006 | Mikkelsen | 254/11 |
| 7,451,671 | B2 * | 11/2008 | Coleman, Jr. | 81/46 |
| 2006/0278859 | A1 | 12/2006 | Fraley | 254/17 |
| 2007/0057241 | A1 | 3/2007 | Fraley | 254/15 |
| 2008/0191180 | A1 | 8/2008 | Gaunt | 254/11 |
| 2011/0067354 | A1 * | 3/2011 | Weng et al. | 52/749.11 |

* cited by examiner

*Primary Examiner* — Lee D Wilson
*Assistant Examiner* — Nirvana Deonauth
(74) *Attorney, Agent, or Firm* — Pillsbury Winthrop Shaw Pittman LLP

(57) ABSTRACT

A flooring installation tool includes a base having a bottom surface configured to engage a top surface of a flooring material, and a shoe having a connection portion and a vertical surface engaging portion. The connection portion is movably connected to a gear housing supported by the base, and the vertical surface engaging portion is configured to engage a vertical surface of the flooring material. An adjuster is configured to selectively hold the shoe relative to the base in a first position or in a second position that is different from the first position.

25 Claims, 10 Drawing Sheets

FLOORING INSTALLATION TOOL WITH ADJUSTABLE SHOE

FIELD

This application is generally related to a tool that may be used to install flooring, and more particularly related to a flooring installation tool with an adjustable shoe that may be used in different installation configurations.

BACKGROUND

Flooring installation tools are used to install, for example, strips or planks of flooring made out of wood. Because strips and planks of wood may have bows in them, it is desirable to be able to straighten the boards as much as possible prior to fastening the boards to a subfloor. In certain installations, the tool may be attached to the subfloor and arranged to push a board to be fastened to the subfloor against boards that have already been fastened to the subfloor so that a tight fit may be achieved.

In other installations, it may be desirable to place the tool on top of the boards that have already been fastened to the subfloor, and essentially pull the next board to be fastened to the subfloor towards the boards that have already been fastened. In view of the range of thicknesses currently offered for flooring materials, it is desirable to have a tool that may be adjusted to accommodate both types of installations. In addition, it is desirable to have an all-in-one tool that does not have parts that should be removed to make the adjustments.

SUMMARY

According to an aspect of the invention, there is provided a flooring installation tool that includes a base having a bottom surface configured to engage a top surface of a flooring material, a gear housing supported by the base, a gear supported by the gear housing, and a pusher configured to engage a vertical surface. The pusher includes a rack of teeth. The rack of teeth and the gear are configured to cooperate with each other so that rotation of the gear causes movement of the rack relative to the base. A handle is operatively connected to the gear so that when the handle is moved relative to the gear housing, the gear rotates in at least one direction. The flooring installation tool also includes a shoe having a connection portion and a vertical surface engaging portion. The connection portion is movably connected to the gear housing and the vertical surface engaging portion is configured to engage a vertical surface of the flooring material. An adjuster is configured to selectively hold the shoe relative to the base in a first position or in a second position that is different from the first position.

According to an aspect of the invention, there is provided a method for adjusting a flooring installation tool between a configuration in which a base of the flooring installation tool is placed on top of a surface of flooring material that has already been attached to a subfloor and a configuration in which the base of the flooring installation tool is placed directly on top of a surface of the subfloor. The flooring installation tool includes a shoe movably connected to the base. The method includes moving the shoe from a first position in which a lip of the shoe extends below a bottom surface of the base to a second position in which the lip of the shoe is located above the bottom surface of the base.

Other aspects, features, and advantages of the invention will become apparent from the following detailed description, the accompanying drawings, and the appended claims.

BRIEF DESCRIPTION OF THE DRAWINGS

Embodiments of the invention will now be described, by way of example only, with reference to the accompanying schematic drawings in which corresponding reference symbols indicate corresponding parts, in which in at least one of the drawings parts are drawn to scale with respect to each other, and in which.

DETAILED DESCRIPTION

Figure 1:
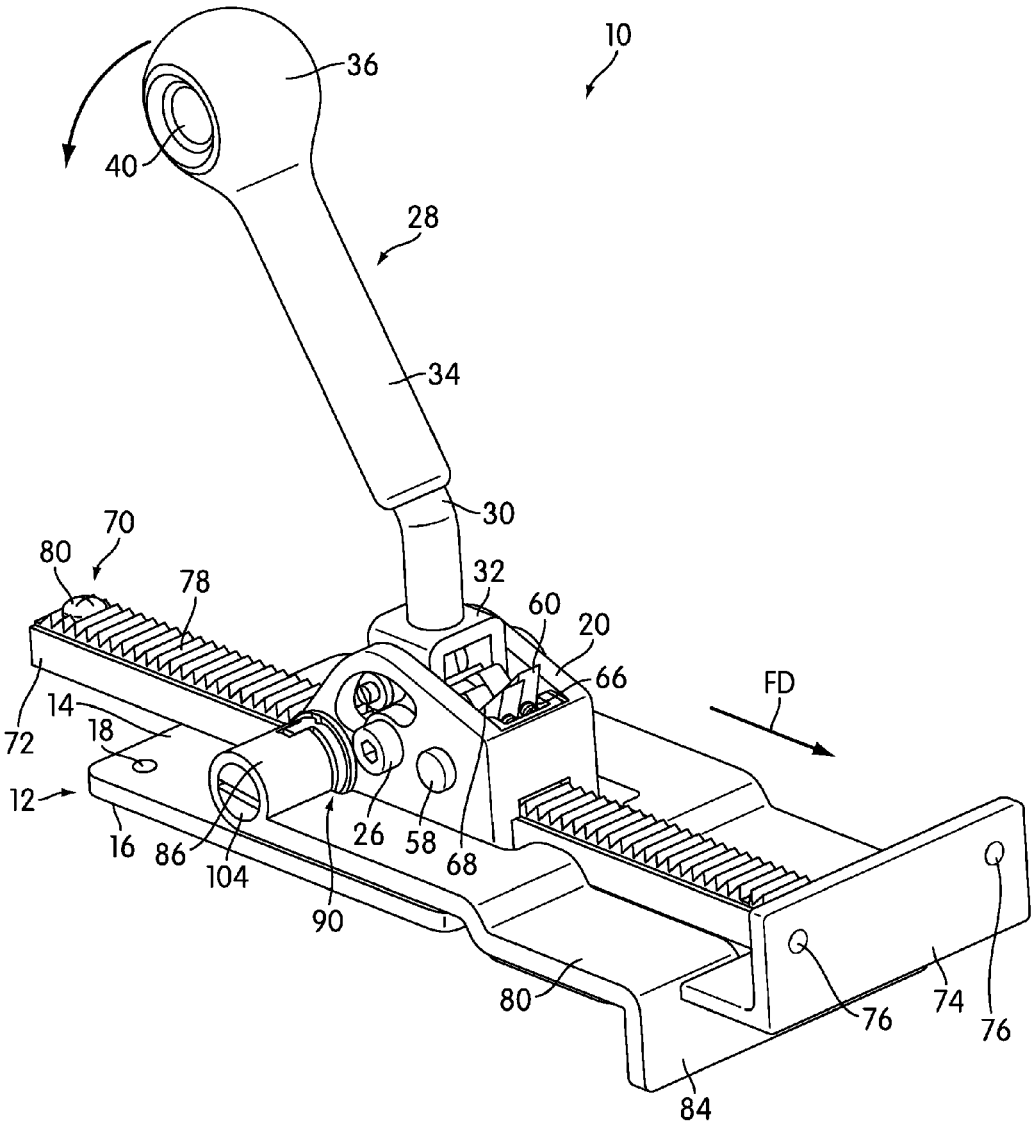
FIG. 1 is a perspective view of a flooring installation tool according to an embodiment of the invention.

FIG. 1 illustrates a flooring installation tool 10 in accordance with an embodiment of the invention. The tool 10 includes a base 12 having a top surface 14 and a bottom surface 16. As illustrated, the base 12 may be in the form of a plate, but the illustrated embodiment is not intended to be limiting in any way. The bottom surface 16 of the base 12 is configured to rest on flooring material. A pad 17 may be connected to the base 12 and therefore may be considered to be part of the base 12 such that a bottom surface of the pad 17 is the bottom surface 16 of the base 12. It may be desirable to use the pad 17 when the tool 10 is placed on flooring material that has already been finished.

As discussed in further detail below, the flooring material may be a subfloor on which strips or planks of wood flooring are installed, or the flooring material may be the strips or planks of wood flooring that have already been installed and are being installed. The base 12 may include a plurality of holes 18 that are configured to allow fasteners to pass therethrough to allow the base 12 to be temporarily attached to the flooring material, particularly when the flooring paternal is the subfloor, if desired.

The tool 10 also includes a gear housing 20 that is supported by the base 12. The gear housing 20 may be formed integrally with the base 12, or may be otherwise connected to the base 12 via welding or any other suitable fastening technique. The gear housing 20 is configured to support a gear 22, which includes a plurality of teeth 24 on an outer circumference thereof, via a shaft 26. The shaft 26 passes through two holes 27 located on the gear housing 20 such that the gear 22 is located within the gear housing 20 in between the two holes 27. The shaft 26 may be in the form of a smooth pin or a threaded fastener having threads on a portion of the fastener that extends through the gear housing 20 so that the shaft 26 is generally supported by the housing at opposite end portions of the shaft 26. In the illustrated embodiment, the shaft 26 includes a fastener 26*a* that includes a smooth shaft portion 26*b* that is configured to support the gear 22, and a threaded portion 26*c* that is configured to receive a nut 26*d* that may be used to secure the shaft 26 to the gear housing 20. The gear 22 and the shaft 26 are configured so that the gear 22 may rotate relative to the gear housing 20. In an embodiment, the shaft is fixedly mounted to the gear housing 20 and the gear 22 is rotatably mounted to the shaft 26. A bushing may be disposed between the gear 22 and the shaft 26 to provide smooth rotation of the gear 22 relative to the shaft 26 in embodiments where the shaft is fixed to the gear housing 20.

As illustrated in FIG. 1, a handle 28 is operatively connected to the gear 22 so that when the handle 28 is moved relative to the gear housing 20, the gear 22 may rotate in at least one direction, as discussed in further detail below. In the illustrated embodiment, the handle 28 may be supported at one end by the gear housing 20 via the shaft 26 that is used to support the gear 22 so that when the handle 28 is moved, e.g., pivoted, the gear 22 rotates. The handle 28 may include an elongated portion 30, a bracket 32 at one end of the elongated portion 30, and a cover 34 that covers the other end of the elongated portion 30. The cover 34 may include an enlarged portion 36 that is configured to be grasped by a user of the tool 10. In the illustrated embodiment, the enlarged portion 36 has a shape of a knob. It is also contemplated that the enlarged portion may be elongated in a direction that is substantially perpendicular to the elongated portion 30 of the handle so as to form a T-shaped handle. The illustrated embodiment is not intended to be limiting in any way. The enlarged portion 36 may include a hole 40 therethrough that is configured to allow a rod-shaped member to extend through the hole 40 so that additional leverage may be applied to the handle, if desired.

Figure 2:
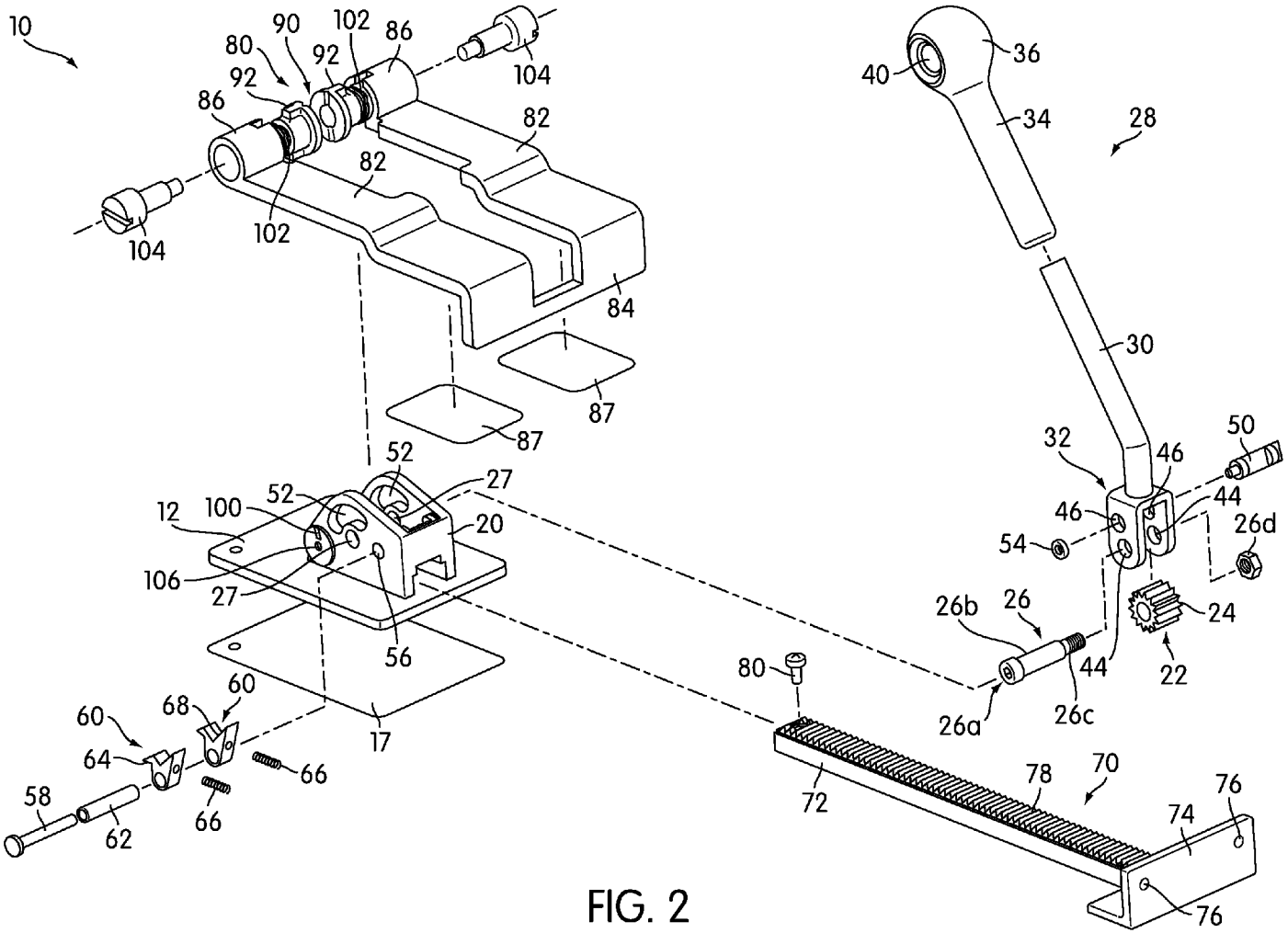
FIG. 2 is an exploded view of the flooring installation tool of FIG. 1.

The bracket 32 of the handle 28 is configured to be supported by and operatively connected to the gear housing 20. As illustrated in FIG. 2, the bracket 32 is configured to receive the gear 22 prior to the shaft 26 being passed through the gear housing 20, the bracket 32, and the gear 22. The bracket 32 includes a first pair of holes 44 that are configured to receive the shaft 26, and a second set of holes 46 that are configured to receive a guide pin 50. The guide pin 50 is configured to guide the handle 30 along a pair of arcuate slots 52 that are located in side walls of the gear housing 20 when the handle 30 is pivoted about the shaft 26. The pin 50 may be secured in place relative to the handle 30 with a suitable connector 54, as illustrated.

The gear housing 20 also includes a pair of holes 56 (although only one of the holes is visible in FIG. 2) that are configured to support a shaft 58 that is configured to support a pair of pawls 60. A bushing 62 may be disposed in between the pawls 60 and the shaft 58 so that the pawls 60 may rotate relative to the shaft 58. The shaft 58 may be held in place relative to the gear housing 20 with a suitable connector (not shown).

Each pawl 60 includes a tooth 64 that is configured to engage the plurality of teeth 24, one at a time, on the gear 22. A biasing member 66 may be disposed in between the gear housing 20 and each pawl 60 so that the pawls 60 are biased towards the gear 22 such that the teeth 64 of the pawls 60 engage the teeth 24 of the gear 22 to create a ratchet. The pawls 60 may be of different designs from one another so that each pawl 60 is configured to engage a different tooth 24 on the gear 22. The pawls 60 are also configured to allow the user to press each pawl 60 at a location along an extension 68 of the pawl 60 against the biasing force of the corresponding biasing member 66 so that the teeth 64 of the pawls 60 disengage from the teeth 24 of the gear 22. This disengagement allows for the gear 22 to freely rotate relative to the gear housing 20, which will be discussed in further detail below.

The tool 10 also includes a pusher 70 that has an elongated portion 72 that is supported by the base 12, and a vertical surface engagement portion 74 that is configured to engage a surface that is substantially perpendicular to the base 12 and the flooring material on which the base 12 is placed. As illustrated, the vertical surface engagement portion 74 has a substantially L-shaped cross section so that the portion 74 may also engage a horizontal surface, as well as a vertical surface. The vertical surface engagement portion 74 of the pusher 70 may also include holes 76 that are configured to allow fasteners to pass therethrough in situations where it is desirable to attach the vertical surface engagement portion 74 to a vertical surface.

The elongated portion 72 of the pusher 70 is configured to pass through the gear housing 20, as illustrated in FIG. 1. The elongated portion 72 includes a rack of teeth 78 that is configured to mesh with the plurality of teeth 24 on the gear 22 that is mounted in the gear housing 20. This arrangement is commonly referred to as a rack and pinion type gear system. When the handle 28 is pivoted towards the base 12, the gear 22 will rotate relative to the gear housing 20 and will cause the pusher 70 to move in a first direction FD, as illustrated in FIG. 1. The pawls 60 provide a ratchet effect and lock the gear 22 in place as the teeth 24 of the gear 22 engage the teeth 78 of the pusher 70.

If desired, the handle 28 may be pivoted away from the base 12 so that the pusher 70 may be moved further in the first direction FD upon subsequent movement of the handle 28 back towards the base. The mounting of the bracket 32 and the gear 22 on the shaft 26 and gear housing 20 may allow the handle 28 to move relative to the gear 22 when the gear is locked in position by the pawls 60. A fastener 80 may be connected to the elongated portion 72 near an end thereof to block engagement of the gear 22 with the rack 78 when the elongated portion 70 is fully extended relative to the base 12 so that the pusher 70 does not separate from the base 12.

Figure 3:
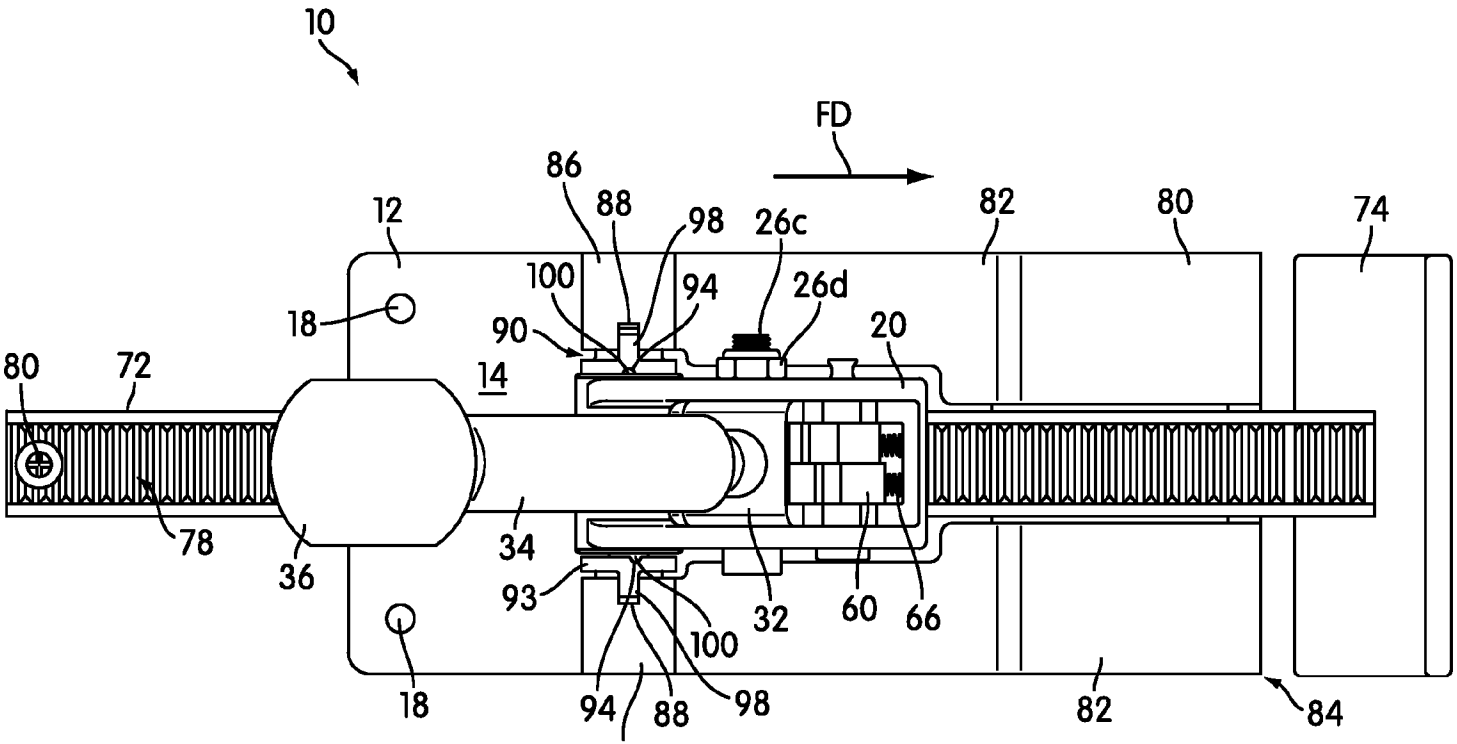
FIG. 3 is a top view of the flooring installation tool of FIG. 1.
Figure 4:
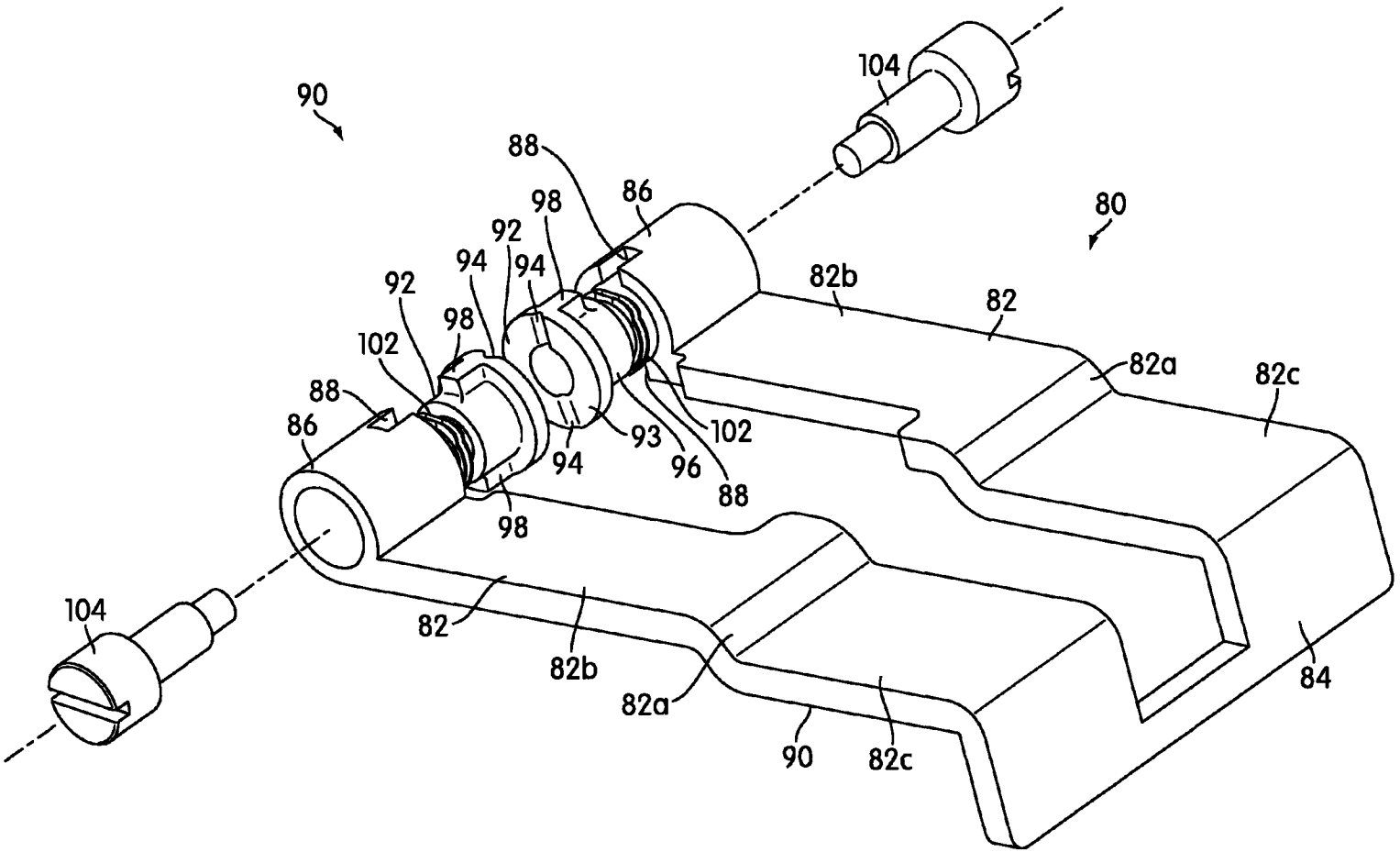
FIG. 4 is a more detailed exploded view of a shoe of the flooring installation tool of FIG. 1.

As illustrated in FIGS. 1 and 2, the tool 10 also includes a shoe 80 that is supported by the base 12. A more detailed view of the shoe 80 is illustrated in FIG. 4. As illustrated, the shoe 80 has a generally U-shaped configuration and includes a pair of elongated portions 82 and a vertical surface engaging portion 84 that connects the elongated portions 82 to each other at one end thereof. The vertical surface engaging portion 84 extends substantially transversely with respect to the elongated portions 82 so as to form a lip. At an opposite end of each elongated portion 82 is a connection portion 86 that is configured to movably connect the shoe 80 to the gear housing 20, and thereby operatively connect the shoe 80 to the base 12 of the tool 10 via the gear housing 20. As illustrated, the connection portion 86 is cylindrical in shape. The connection portion 86 may be integrally formed with the elongated portion 82, or may be separately formed and welded or otherwise fastened to the elongated portion 82. In the embodiment illustrated in FIGS. 1-4, each connection portion 86 includes a pair of recesses or notches 88 that are located 180° from each other in a surface that faces the gear housing 20 when the shoe 80 is mounted to the gear housing 20, as illustrated in FIG. 3. The purpose of these recesses 88 will be described in further detail below.

Figure 5:
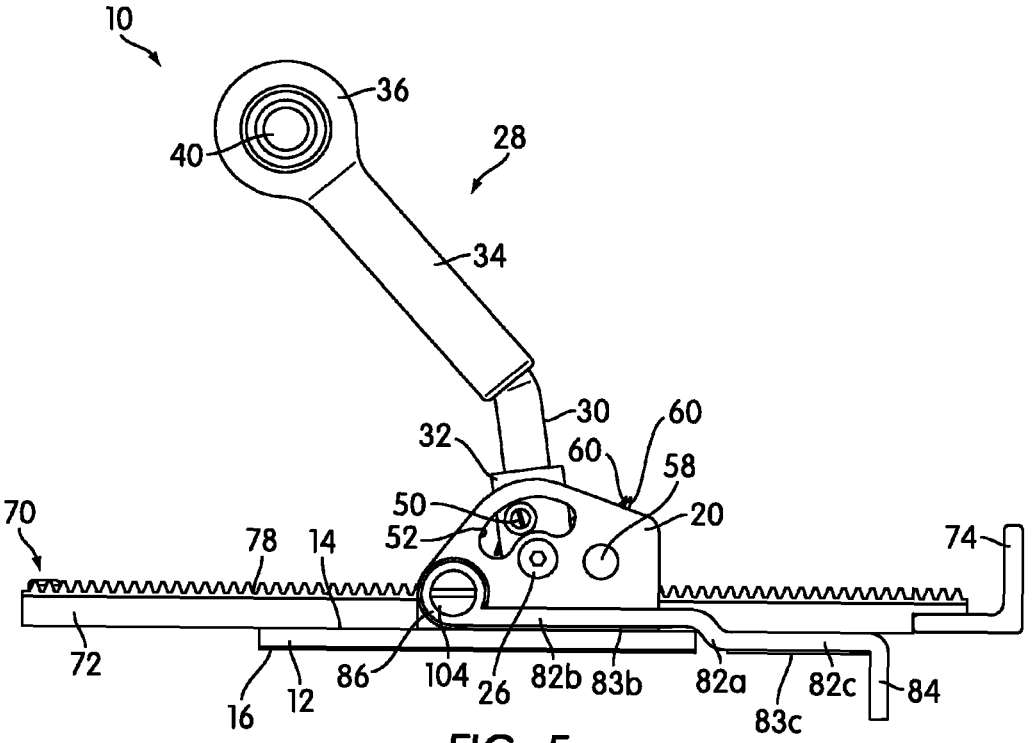
FIG. 5 is a side view of the flooring installation tool of FIG. 1 with the shoe in a first position.

The elongated portion 82 may include a step 82*a* that transitions a part 82*b* of the elongated portion 82 that is connected to the connection portion 86 with a part 82*c* of the elongated portion 82 that is connected to the vertical surface engaging portion 84. As illustrated in FIG. 5, the step 82*a* is configured to allow a bottom surface 83*b* of the part 82*b* to be located above and substantially parallel to the top surface 14 of the base 12, and a bottom surface 83*c* of the part 82*c* to be located in the same plane as the bottom surface 16 of the base 12 when the shoe 80 is in a so-called "down" position relative to the base 12. Similar to the pad 17 that may be attached to the base 12 to define the bottom surface 16 of the base 12, a pair of pads 87, as shown in FIG. 2, may be provided to the part 82*c* of the shoe 80 to define a bottom surface of the shoe that may contact finished flooring material in certain configurations of the tool 10.

Figure 6:
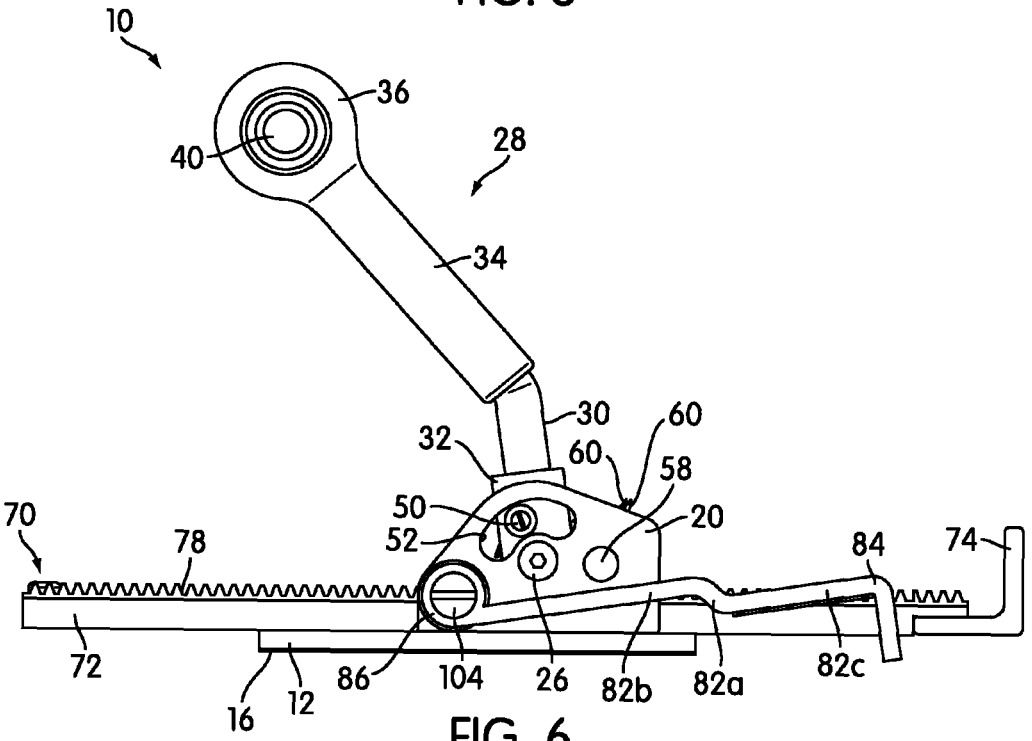
FIG. 6 is a side view of the flooring installation tool of FIG. 1 with the shoe in a second position.

Returning to FIG. 4, the tool 10 also includes an adjuster 90 that is configured to allow adjustment of the position of the shoe 80 and to selectively hold the shoe 80 relative to the base 12 in the so-called "down" position illustrated in FIG. 5 or a so-called "up" position, as illustrated in FIG. 6. The adjuster 90 includes a pair of bushings 92 that provide an operative connection between the shoe 80 and the gear housing 20. Each bushing 92 includes a flange 93 that includes two recesses or notches 94 located 180° from each other, and a cylindrical portion 96 that includes two protrusions 98 that are configured to be inserted into the recesses 88 located on the cylindrical portion 86 of the shoe 80. The engagement of the protrusions 98 of the bushings 92 and the recesses 88 of the shoe 80 allow the shoe 80 to rotate along with the bushing 92. At least one of the recesses 94 of each bushing 92 is configured to receive a corresponding protrusion or boss 100 located on the gear housing 20, as illustrated in FIGS. 2 and 3. When a recess 94 of a bushing 92 is positioned to receive the protrusion 100 located on the gear housing 20, the shoe 80 may be locked into that position.

As shown in FIGS. 2 and 3, the upper recess 94 of one of the bushings 92 is aligned with the protrusion 98 on the same bushing 92, while the recess 94 of the other bushing 92 is offset from the protrusion 98 of that bushing 92 by about 10°. This allows for the locking of the shoe 80 in two different positions. For example, when the recess 94 that is aligned with the protrusion 98 of the same bushing 92 receives the protrusion 100 on the gear housing 20, as illustrated in FIG. 3, the shoe 80 may be locked in the so-called "down" position, as illustrated in FIG. 5. When the shoe 80 is pivoted upward from the so-called "down" position to the so-called "up" position, as illustrated in FIG. 6, the offset recess 94 of the other bushing 92 may be aligned with the protrusion 100 of the other side of the gear housing 20 so as to lock the shoe 80 in the so-called "up" position. When the shoe 80 is in the "up" position, the lip 84 of the shoe 80 is above a plane that includes the bottom surface 16 of the base 12.

In order to bias the bushings 92 towards the gear housing 20 so that the recesses 94 of each bushing 92 may engage the corresponding protrusions 100 on the gear housing 20, a biasing member 102 and a fastener 104 may be provided for each bushing 92. The biasing member 102 may be a spring in the form of a spring wave washer, for example. Each fastener 104 may be inserted into the cylindrical portion 86 of the shoe 80, extend through the bushing 92, and into a hole 106 in a side wall of the gear housing 20. In an embodiment, the fastener 104 is threadingly received by the gear housing 20 and secured into position with a tool, such as a screwdriver. No tool should be needed to move the shoe 80 in between the so-called "down" and so-called "up" positions, which may be advantageous to a person installing the flooring. Additional protrusions that correspond with additional positions of the shoe 80 relative to the base 12 may be provided to the gear housing 20. The illustrated embodiment is not intended to be limiting in any way.

Figure 7:
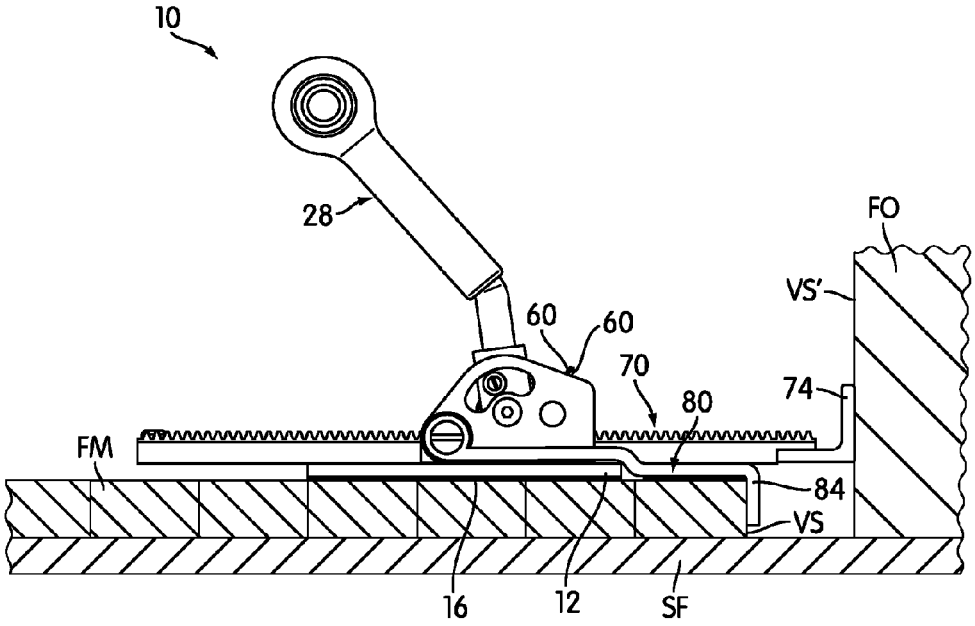
FIG. 7 is a side view of the flooring installation tool of FIG. 5 in use.

As illustrated in FIG. 7, when the shoe 80 is in the "down" position, the tool 10 may be placed on top of flooring F that has already been installed on a subfloor SF such that the bottom surface of the base 12, with or without the pad 17, may contact a top surface TS of the flooring, and the lip 84 of the shoe 80 may be place along a vertical side surface VS of the flooring F. Although not illustrated in FIG. 7, the vertical side surface VS of the flooring may be defined by a tongue when the flooring is comprised of tongue-and-groove type boards. In order to ensure that the board being installed is straight and tight with the rest of the flooring F that was previously installed, the tool 10 may be operated so that the vertical surface engagement portion 74 of the pusher 70 engages a vertical surface VS' that is provided by a firmly secured object FO, such as a wall or a board that is securely fastened to the subfloor, for example. The vertical surface VS' should be at a suitable distance so as to allow enough pressure to be applied by the lip 84 of the shoe 80 to the board being installed.

To operate the tool 10 when the tool 10 is in the configuration illustrated in FIG. 7, the user may initially adjust the position of the pusher 70 relative to the base 12 so that the distance between the lip 84 of the shoe 80 and the vertical engagement portion 74 of the pusher is slightly less than the distance between the two vertical surfaces VS, VS'. This adjustment may be considered to be a "macro" adjustment. The base 12 of the tool 10 may then be placed on top of the flooring F so that the lip 84 of the shoe 80 engages the vertical surface VS of the flooring. The user may then move the handle 28 towards the base 12 to start the ratcheting action of the gear 22 and pawls 60 to move the pusher 70 towards the vertical surface VS'. As the vertical engagement portion 74 of the pusher 70 engages the vertical surface VS' of the firmly secured object FO, a force will be applied to the vertical surface VS', and an equal and opposite force will be applied to the vertical surface VS of the flooring F. The user may continue to advance the pusher 70 until the pusher 70 cannot be moved any further, or until the user is satisfied that the flooring being installed is sufficiently straight and tight with the previously installed flooring. Such an adjustment may be considered to be a "micro" adjustment, particularly when compared to the macro adjustment described above. When the tool 10 is no longer needed to apply pressure to the flooring F, the user may disengage the pawls 60 from the gear 22, as described above, so that pusher 70 may be moved away from the vertical surface VS' of the firmly secured object FO.

Figure 8:
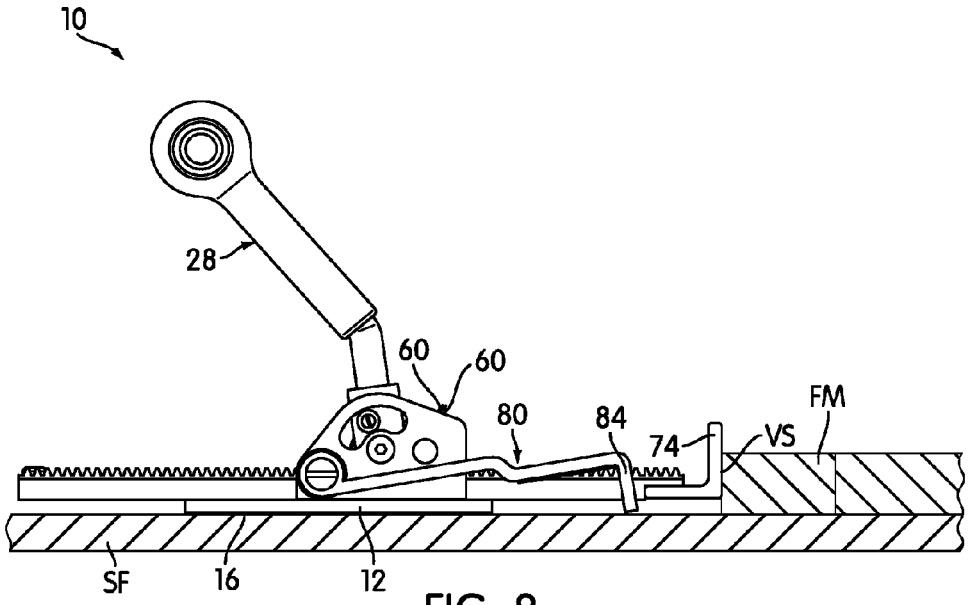
FIG. 8 is a side view of the flooring installation tool of FIG. 6 in use.

To move the shoe 80 to the so-called "up" position, the user may pivot the shoe 80 away from the base 12 until the shoe 80 locks into the "up" position via the corresponding recess 94 on the bushing 92 and the protrusion 100 on the gear housing 20. As illustrated in FIG. 8, when the shoe 80 of the tool 10 is in the "up" position, the tool 10 may be placed on the subfloor SF so that the bottom surface 16 of the base 12 rests directly on the subfloor SF. The base 12 may be fastened to the subfloor SF with fasteners that may be passed through the holes 18 of the base 12 after the tool 10 is placed at a desired location. The pusher 70 may be extended towards the vertical surface VS of the flooring F via a "macro" adjustment as described above until the vertical engagement portion 74 of the pusher 70 engages the vertical surface VS of the flooring F. The user may then move the handle 28 towards the base 12 to start the ratcheting action of the gear 22 and pawls 60 to move the pusher 70 towards the vertical surface VS. As the vertical engagement portion 74 of the pusher 70 engages the vertical surface VS of the firmly secured object FO, a force will be applied to the vertical surface VS, and an equal and opposite force will be applied to the fasteners holding the base 12 to the subfloor SF. The user may continue to advance the pusher 70 until the pusher 70 cannot be moved any further, or until the user is satisfied that the flooring being installed is sufficiently straight and tight with the previously installed flooring. When the tool 10 is no longer needed to apply pressure to the flooring F, the user may disengage the pawls 60 from the gear 22 so that pusher 70 may be moved away from the vertical surface VS of the flooring.

Figure 9:
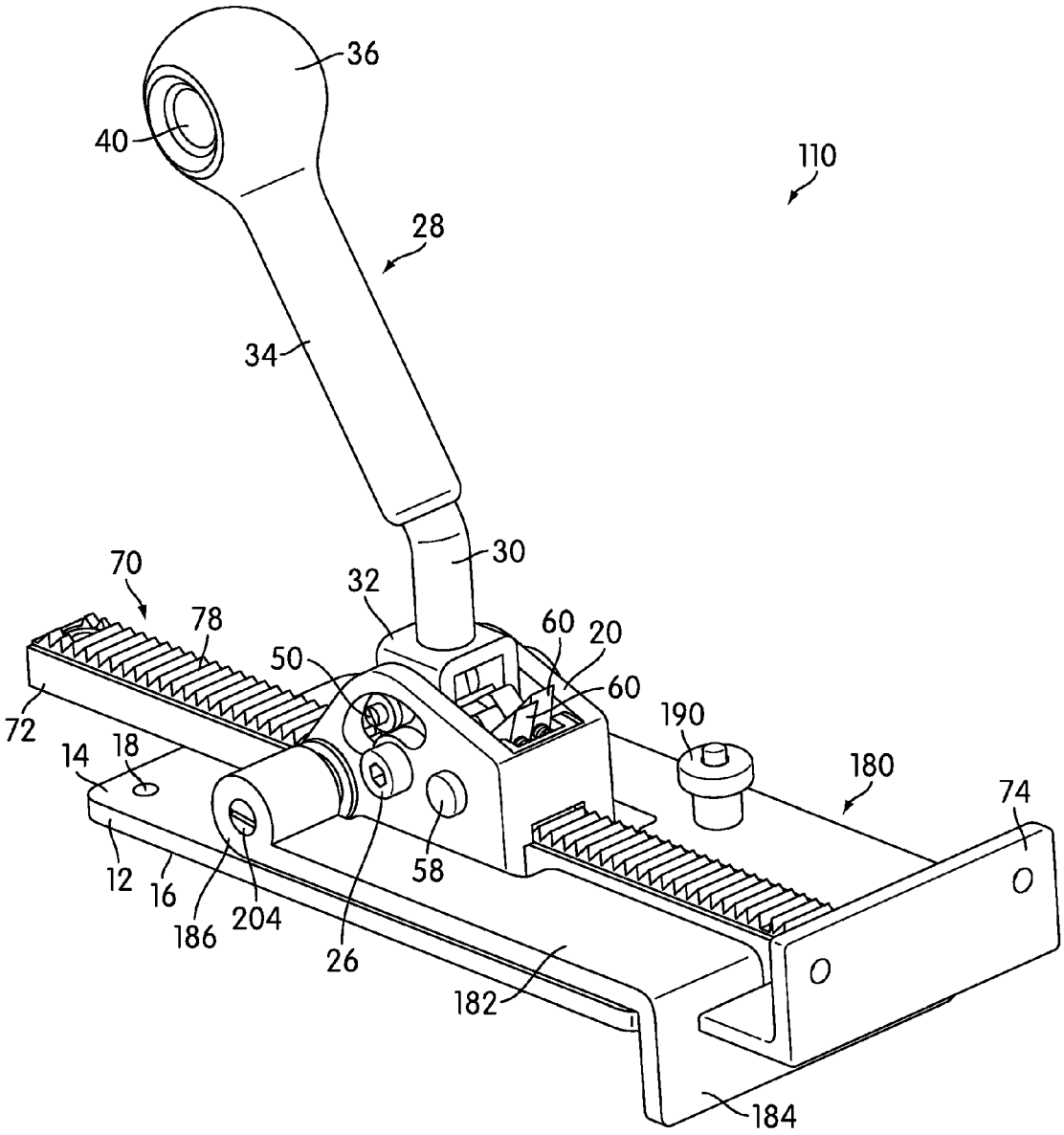
FIG. 9 is a front perspective view of a flooring installation tool according to an embodiment of the invention.
Figure 10:
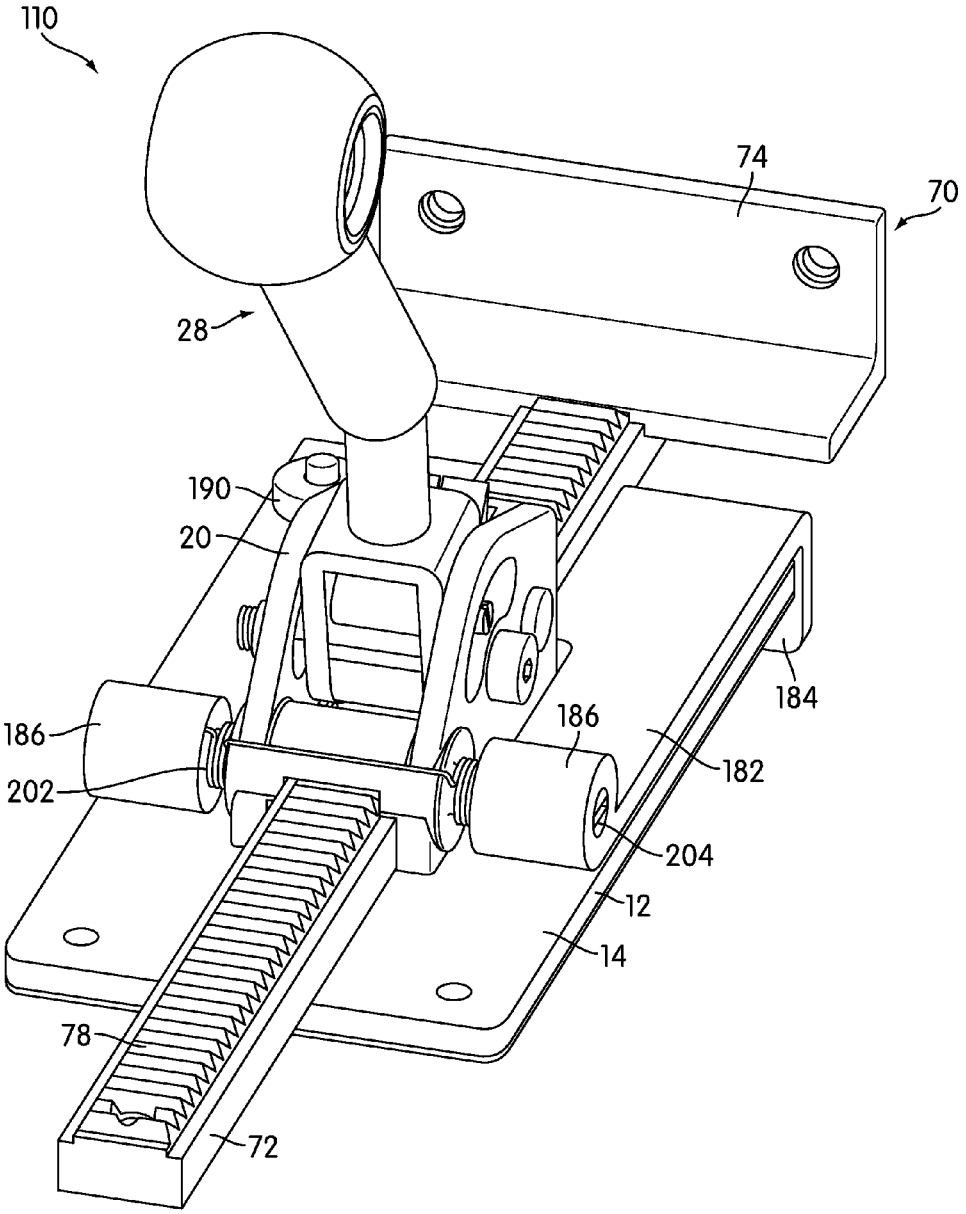
FIG. 10 is a rear perspective view of the flooring installation tool of FIG. 9.

FIGS. 9 and 10 illustrate a flooring installation tool 110 according to an embodiment of the invention. As shown therein, the tool 110 includes many common features with the tool 10 of FIGS. 1-6 and therefore only the features that are different from the tool 10 will be described in further detail below.

The tool 110 include a shoe 180 that includes a pair of elongated portions 182 that are connected to each other at respective ends by a lip 184 that extends substantially perpendicularly to the elongated portions 182. The shoe 180 also includes a cylindrical portion 186 at each end of a respective elongated portion 182 that is opposite the lip 184. Each cylindrical portion 186 may be operatively connected to the gear housing 20 via a fastener 204 or any other suitable cylindrical structure that passes through the cylindrical portion 186. A biasing member 202 may be positioned in between each cylindrical portion 186 and the gear housing 20. In the illustrated embodiment, the biasing member 202 is a torsion spring that has one end connected to each of the cylindrical portions 186. Although a single torsion spring is illustrated in FIG. 10, separate torsion springs may be provided for each of the cylindrical portions 186. The biasing member 202 is configured to bias the shoe 180 away from the base 12 in the so-called "up" position.

As illustrated in FIG. 9, the tool 110 also includes an adjuster 190 that is configured to pass through one of the elongated portions 182 of the shoe 180 and be operatively connected to the base 12. In an embodiment, the adjuster 190 is a fastener that is threadingly received by the base 12. The adjuster 190 is configured to work against the biasing force of the biasing member 202 so that the shoe 180 can be positioned relative to the base 12 in a range of positions. For example, if it is desirable to have the shoe 180 in a position in which a bottom surface of the shoe 180 contacts the top surface 14 of the base 12, so that the shoe 180 is in the so-called "down" position, the adjuster 190 may be rotated in a tightening direction until the adjuster 190 cannot be rotated any further. If it is desirable to have the shoe 180 in a position in which a distal end of the lip 184 is above the bottom surface 16 of the base 12, such as when the shoe 180 is in the so-called "up" position, the adjuster 190 may be rotated in a loosening direction until the distal end of the lip 184 is above the bottom surface 16 of the base 12. Of course, the adjuster 190 may be used to position the shoe 180 at any position in between the "down" and "up" positions, which may be useful to accommodate flooring having different thicknesses.

The tool 110 of FIGS. 9 and 10 otherwise operates in the same manner as the tool 10 of FIGS. 1-6. For example, the tool 110 may be used in the configurations illustrated in FIGS. 7 and 8 with respect to the flooring F, the subfloor SF, and the fixed object FO. The ratcheting action of the handle 28, the gear 22, and the pawls 60 may also be the same as described above with respect to the tool 10 of FIGS. 1-6.

Figure 11:
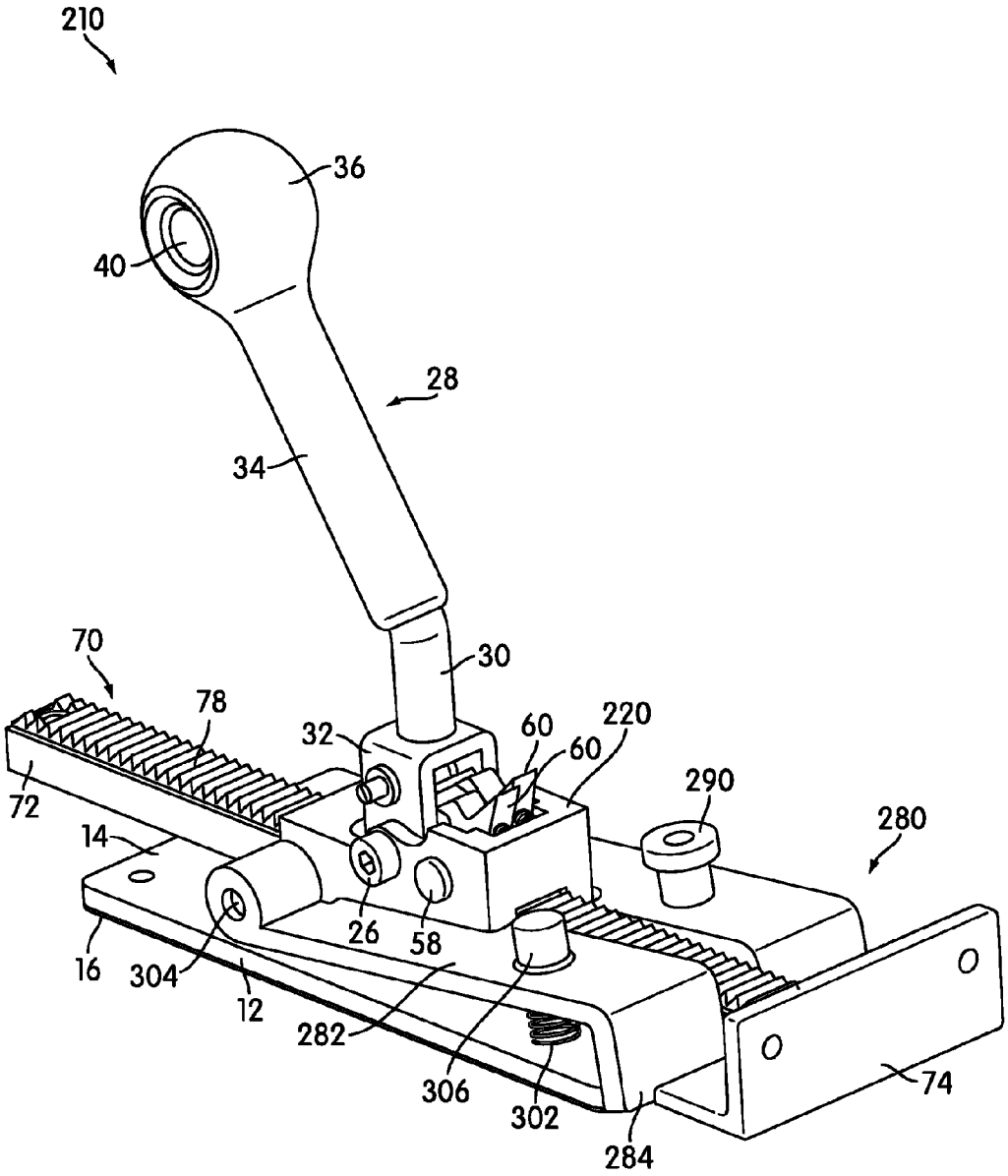
FIG. 11 is a perspective view of a flooring installation tool according to an embodiment of the invention.
Figure 12:
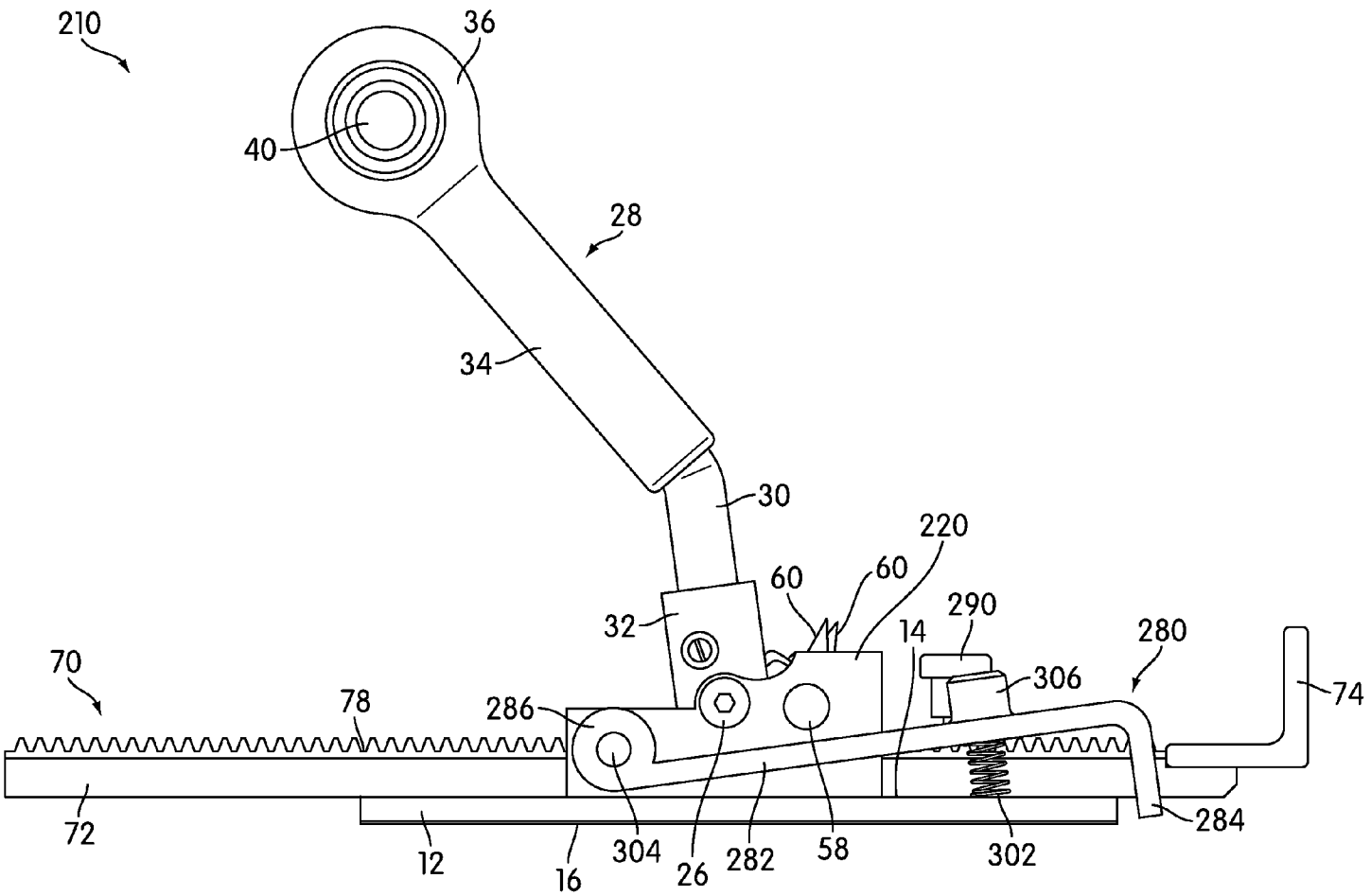
FIG. 12 is a side view of the flooring installation tool of FIG. 11.

FIGS. 11 and 12 illustrate a flooring installation tool 210 according to an embodiment of the invention. As shown therein, the tool 210 includes many common features with the tool 10 of FIGS. 1-6 and the tool 110 of FIGS. 9 and 10 and therefore only the features that are different from the tool 10 and the tool 110 will be described in further detail below.

The tool 210 include a shoe 280 that includes a pair of elongated portions 282 that are connected to each other at respective ends by a lip 284 that extends substantially perpendicularly to the elongated portions 282. The shoe 280 also includes a cylindrical portion 286 at each end of a respective elongated portion 282 that is opposite the lip 284. Each cylindrical portion 286 may operatively connected to a gear housing 220 via a fastener 304 or any other suitable cylindrical structure that may pass through the cylindrical portion 286.

A biasing member 302 may be positioned in between one of the elongated portions 282 of the shoe 280 and the top surface 14 of the base 12. In the illustrated embodiment, the biasing member 302 is a coil spring that passes through the elongated portion 282 of the shoe 280 and is received by a cap 306 that may be connected to the elongated portion 282 of the shoe 280. An opposite end of the biasing member 302 may rest on the top surface 14 of the base 12 or may be received by a recess (not shown) in the top surface 14. The illustrated embodiment is not intended to be limiting in any way. The biasing member 302 is configured to bias the shoe 280 away from the base 12 in a so-called "up" position.

As illustrated in FIG. 11, the tool 210 also includes an adjuster 290 that is configured to pass through one of the elongated portions 282 of the shoe 280 and be operatively connected to the base 12. Similar to the adjuster 190 described above with respect to FIG. 10, the adjuster 290 may be a fastener that is threadingly received by the base 12. The adjuster 290 is configured to work against the biasing force of the biasing member 302 so that the shoe 280 can be positioned relative to the base 12 in a range of positions. For example, if it is desirable to have the shoe 280 in a position in which a bottom surface of the shoe 280 contacts the top surface 14 of the base 12, so that the shoe 280 is in the so-called "down" position, the adjuster 290 may be rotated in a tightening direction until the adjuster 290 cannot be rotated any further. If it is desirable to have the shoe 280 in a position in which a distal end of the lip 284 is above the bottom surface 16 of the base 12, such as when the shoe 280 is in the so-called "up" position, the adjuster 290 may be rotated in a loosening direction until the distal end of the lip 284 is above the bottom surface 16 of the base 12. Of course, the adjuster 290 may be used to position the shoe 280 at any position in between the "down" and "up" positions.

The tool 210 of FIGS. 11 and 12 otherwise operates in the same manner as the tool 10 of FIGS. 1-6 and the tool 110 of FIGS. 9 and 10. For example, the tool 210 may be used in the configurations illustrated in FIGS. 7 and 8 with respect to the flooring F, the subfloor SF, and the fixed object FO. The ratcheting action of the handle 28, the gear 22, and the pawls 60 may also be the same as described above with respect to the tool 10 of FIGS. 1-6.

By having the shoe pivotally connected to the remaining portions of the flooring installation tool, a user may use embodiments of the tool in both configurations described above, without having to add or remove parts of the tool, which may be advantageous over tools of the prior art.

While specific embodiments of the invention have been described above, it will be appreciated that the invention may be practiced otherwise than as described. The descriptions above are intended to be illustrative, not limiting. Thus, it will be apparent to one skilled in the art that modifications may be made to the invention as described without departing from the scope of the claims set out below.

What is claimed is:

1. A flooring installation tool comprising:

a base having a bottom surface configured to engage a top surface of a flooring material;

a gear housing supported by the base;

a gear supported by the gear housing;

a pusher configured to engage a vertical surface of an object separate from the flooring installation tool, the pusher comprising a rack of teeth, the rack of teeth and the gear being configured to cooperate with each other so that rotation of the gear causes movement of the rack relative to the base;

a handle operatively connected to the gear so that when the handle is moved relative to the gear housing, the gear rotates in at least one direction;

a shoe having a connection portion and a vertical surface engaging portion, the connection portion being pivotally connected to the gear housing and the vertical surface engaging portion being configured to engage a vertical surface of the flooring material when the pusher engages the vertical surface of the object; and an adjuster configured to selectively hold the shoe relative to the base in a first position or in a second position that is different from the first position, the adjuster comprising a bushing operatively connected to the connection portion of the shoe and to the gear housing.

2. The flooring installation tool according to claim 1, wherein the vertical surface engaging portion of the shoe comprises a lip that extends below the bottom surface of the base when the shoe is in the first position.

3. The flooring installation tool according to claim 2, wherein the vertical surface engaging portion of the shoe is positioned above the bottom surface of the base when the shoe is in the second position.

4. The flooring installation tool according to claim 1, wherein the bushing comprises a recess and the gear housing comprises a protrusion configured to engage the recess when the shoe is in the second position.

5. The flooring installation tool according to claim 4, wherein the adjuster further comprises a second bushing having a recess and when the gear housing comprises a second protrusion configured to engage the recess of the second bushing when the shoe is in the first position.

6. The flooring installation tool according to claim 1, further comprising a biasing member configured to bias the shoe in the second position.

7. The flooring installation tool according to claim 6, wherein the biasing member comprises a torsion spring connected to the connection portion of the shoe and operatively connected to the gear housing.

8. The flooring installation tool according to claim 6, wherein the biasing member comprises a coil spring disposed between the shoe and the base.

9. The flooring installation tool according to claim 6, wherein the adjuster comprises a fastener configured to push the shoe towards a top surface of the base against the bias of the biasing member when the fastener is rotated in a first direction.

10. The flooring installation tool according to claim 1, wherein the adjuster is configured to hold the shoe relative to the base in at least one additional position in between the first position and the second position.

11. The flooring installation tool according to claim 1, wherein the handle is pivotally connected to the gear housing.

12. The flooring installation tool according to claim 1, wherein rotation of the gear causes linear movement of the rack relative to the base.

13. A flooring installation tool comprising:

a base having a bottom surface configured to engage a top surface of a flooring material;

a gear housing supported by the base;

a gear supported by the gear housing;

a pusher configured to engage a vertical surface of an object separate from the flooring installation tool, the pusher comprising a rack of teeth, the rack of teeth and the gear being configured to cooperate with each other so that rotation of the gear causes movement of the rack relative to the base;

a handle operatively connected to the gear so that when the handle is moved relative to the gear housing, the gear rotates in at least one direction;

a shoe having a connection portion and a vertical surface engaging portion, the connection portion being pivotally connected to the gear housing and the vertical surface engaging portion being configured to engage a vertical surface of the flooring material when the pusher engages the vertical surface of the object;

an adjuster configured to selectively hold the shoe relative to the base in a first position or in a second position that is different from the first position; and a ratchet comprising a pawl operatively connected to the gear housing and a biasing member disposed between the gear housing and the pawl, the pawl having a tooth configured to engage the gear and the biasing member being configured to bias the pawl into engagement with the gear.

14. The flooring installation tool according to claim 13, wherein the vertical surface engaging portion of the shoe comprises a lip that extends below the bottom surface of the base when the shoe is in the first position.

15. The flooring installation tool according to claim 14, wherein the vertical surface engaging portion of the shoe is positioned above the bottom surface of the base when the shoe is in the second position.

16. The flooring installation tool according to claim 13, wherein the adjuster comprises a bushing operatively connected to the connection portion of the shoe and to the gear housing.

17. The flooring installation tool according to claim 16, wherein the bushing comprises a recess and the gear housing comprises a protrusion configured to engage the recess when the shoe is in the second position.

18. The flooring installation tool according to claim 17, wherein the adjuster further comprises a second bushing having a recess and when the gear housing comprises a second protrusion configured to engage the recess of the second bushing when the shoe is in the first position.

19. The flooring installation tool according to claim 13, further comprising a second biasing member configured to bias the shoe in the second position.

20. The flooring installation tool according to claim 19, wherein the second biasing member comprises a torsion spring connected to the connection portion of the shoe and operatively connected to the gear housing.

21. The flooring installation tool according to claim 19, wherein the second biasing member comprises a coil spring disposed between the shoe and the base.

22. The flooring installation tool according to claim 19, wherein the adjuster comprises a fastener configured to push the shoe towards a top surface of the base against the bias of the second biasing member when the fastener is rotated in a first direction.

23. The flooring installation tool according to claim 13, wherein the adjuster is configured to hold the shoe relative to the base in at least one additional position in between the first position and the second position.

24. The flooring installation tool according to claim 13, wherein the handle is pivotally connected to the gear housing.

25. The flooring installation tool according to claim 13, wherein rotation of the gear causes linear movement of the rack relative to the base.

* * * * *